United States Patent [19]

Willenbring et al.

[11] 4,330,978

[45] May 25, 1982

[54] PHOTOGRAPHIC FILM PACKING APPARATUS

[75] Inventors: Armer J. Willenbring, Bloomington; Warren J. Osby, Minneapolis; Gerald R. Strunc, Maple Grove, all of Minn.

[73] Assignee: Pako Corporation, Minneapolis, Minn.

[21] Appl. No.: 146,508

[22] Filed: May 5, 1980

[51] Int. Cl.[3] ..... B65B 39/00; B65B 5/10

[52] U.S. Cl. ..... 53/435; 53/244; 53/259; 53/473; 53/520; 271/233; 53/258

[58] Field of Search ..... 53/540, 435, 449, 266 A, 53/570, 469, 468, 459, 475, 520, 244, 259, 473, 258; 271/233, 213, 198, 273

[56] References Cited

U.S. PATENT DOCUMENTS

| | | | |
|---|---|---|---|
| 2,829,475 | 4/1958 | Schmidt | 53/570 X |
| 3,874,651 | 4/1975 | Sisson | 271/233 X |
| 4,079,576 | 3/1978 | Morrison et al. | 53/266 A |
| 4,114,349 | 9/1978 | Jensen et al. | 53/520 X |
| 4,139,978 | 2/1979 | Jensen et al. | 53/266 A X |
| 4,139,980 | 2/1979 | Larson et al. | 53/520 |
| 4,245,833 | 1/1981 | Akerström | 271/198 |

*Primary Examiner*—Horace M. Culver

*Attorney, Agent, or Firm*—Kinney, Lange, Braddock, Westman and Fairbairn

[57] ABSTRACT

A photographic film packing apparatus cuts film segments from a web of photographic film, partially overlaps the segments in a shingled manner, and conveys the segments in partially overlapping relationship into an insertion opening of a package, such as a customer order envelope. The apparatus advances the web a selected distance past a knife location, at which a knife assembly is located. The knife assembly severs a film segment from the web. The movement of the film segment is then reversed to cause a trailing edge of the film segment to be deflected downward out of the path of the leading edge of the web. The web is then advanced while the segment is maintained stationary until the web has overlapped the segment by a predetermined amount. The web and the film segment are then conveyed together toward the insertion opening until a desired cut location on the web is aligned with the knife location. The knife assembly then cuts another film segment from the web. As the apparatus continues to operate, additional film segments are partially overlapped in a similar manner until all segments corresponding to a customer's order are severed from the web. The film segments are conveyed in partially overlapping relationship into the insertion opening.

14 Claims, 9 Drawing Figures

PHOTOGRAPHIC FILM PACKING APPARATUS

REFERENCE TO COPENDING APPLICATIONS

Reference is made to a copending patent application by Patrick J. Gilligan and Ted C. Merry entitled "Photographic Film Insertion Apparatus" filed on even date herewith and assigned to the same assignee as the present invention.

BACKGROUND OF THE INVENTION

1. Field of the Invention

The present invention relates to photographic packing equipment.

2. Description of the Prior Art

In commercial photographic processing operations, very high rates of processing must be achieved and maintained in order to operate profitably. For that reason, many rolls (or strips) of photographic film from various customers are typically spliced together for processing and printing purposes. After prints have been made from the photographic film, an individual customer's film must be separated from the large roll of film formed by the spliced-together film strips. Typically, the customer's film is cut into segments (or strips) of several frames each so that the segments can be placed flat in an envelope together with the customer's prints.

In the past, equipment has been developed to eliminate many of the operations required for cutting the film segments. One particularly advantageous apparatus, which automates film cutting, print paper cutting, print sorting, and packaging is known as the Pako Photopacker, manufactured by Pako Corporation, the assignee of the present application. U.S. Pat. Nos. 4,114,349 by G. A. Jensen, L. A. Larson and R. E. Diesch; 4,139,978 by G. A. Jensen and A. J. Willenbring; and 4,139,980, by L. A. Larson and R. E. Diesch illustrate portions of mechanisms which have been used in the Pako Photopacker. The film cutting, conveying and packing mechanism is illustrated in FIG. 3 of U.S. Pat. No. 4,139,978, and is described in further detail in U.S. Pat. No. 4,139,980. In general, this apparatus includes upper and lower conveyor belts positioned to receive individual nonoverlapping cut photographic film segments from a film cutter and inserting those segments into a packaging envelope. As the individual segments are discharged at the discharge end of the conveyor belt assemblies, the individual segments are deflected downward by a deflector element onto the stack of film segments which have previously been cut. The purpose of the deflector element is to cause the trailing edge of each segment to snap downward out of the path of the next segment being conveyed. In this apparatus, each film segment is power driven into the envelope in stacked relation above the previously deposited film segment. Since the segments are nonoverlapping, the apparatus drives only a single segment into the envelope at one time.

While the film conveying and packing mechanism shown in U.S. Pat. Nos. 4,139,978 and 4,139,980 has generally been effective in depositing cut film segments into an order envelope, it has been discovered that there are some circumstances under which jamming of the mechanism can occur. In particular, a problem has been encountered in depositing 35 mm film segments into an order envelope utilizing the prior mechanism. The problem is caused by the sprocket holes of 35 mm film, which do not have a fixed relationship with respect to the individual film frame. In some instances when a segment of 35 mm film is cut from the strip, the cut passes through the sprocket holes which causes the trailing edge of the segment just cut and the leading edge of the next segment to be ragged due to the open segment holes. As the film segment with the ragged leading edge is advanced by the conveying mechanism and is deflected downward onto the top of the previously stacked film segments, the ragged leading edge can catch on the sprocket holes of the previously deposited film segment. When this occurs, the film segment buckles and jams the mechanism, so that further segments cannot be deposited in the envelope.

SUMMARY OF THE INVENTION

This invention is an improved method and apparatus for cutting photographic film segments, conveying the segments, and inserting the segments into an insertion opening of a package. In the present invention, after each photographic film segment is severed from a photographic film web, the severed segment is maintained stationary while the web is advanced to partially overlap the previously severed segment. After a predetermined amount of overlap has been achieved, the web and the previously severed segment are conveyed in partially overlapping relationship until the next segment is severed from the web. This process is repeated until all segments of a customer order are severed and partially overlapped. The segments are conveyed in partially overlapping relationship into the insertion opening.

In a preferred embodiment of the present invention, overlapping of the segments is achieved by reversing motion of each segment after it is severed from the web. This reverse motion causes the trailing edge of the segment to be out of the path of a leading edge of the web as the web is advanced to partially overlap the segment.

DETAILED DESCRIPTION OF THE PREFERRED EMBODIMENTS

In the following detailed description, a preferred embodiment of the apparatus of the present invention is described which is advantageously used in conjunction with the Pako Photopacker. Reference may be made to U.S. Pat. No. 4,139,978 for a more detailed description of the apparatus with which the present invention is used. Reference may also be made to U.S. Pat. No. 4,139,980, which represents a film conveying and packing mechanism previously used with the Pako Photopacker and which the apparatus of the present invention preferably replaces. In the present invention, segments or strips of film of several frames each are cut from a web 10 of photographic film. The film segments corresponding to a particular customer's order are partially overlapped, conveyed downward, and are inserted into an insertion opening formed by layers 12*b* and 12*c* of a multi-layer packaging strip 12 (see FIGS. 7 and 8).

In the Pako Photopacker, multi-layer packaging strip 12 is transported along a transversely inclined conveyor bed (not shown in this application, but shown in U.S. Pat. No. 4,139,978). The individual layers of strip 12 are separated from one another as the strip passes a film and print insertion station, and photographic prints and film segments are inserted into openings created between the separated layers of packaging strip 12.

Figure 1:
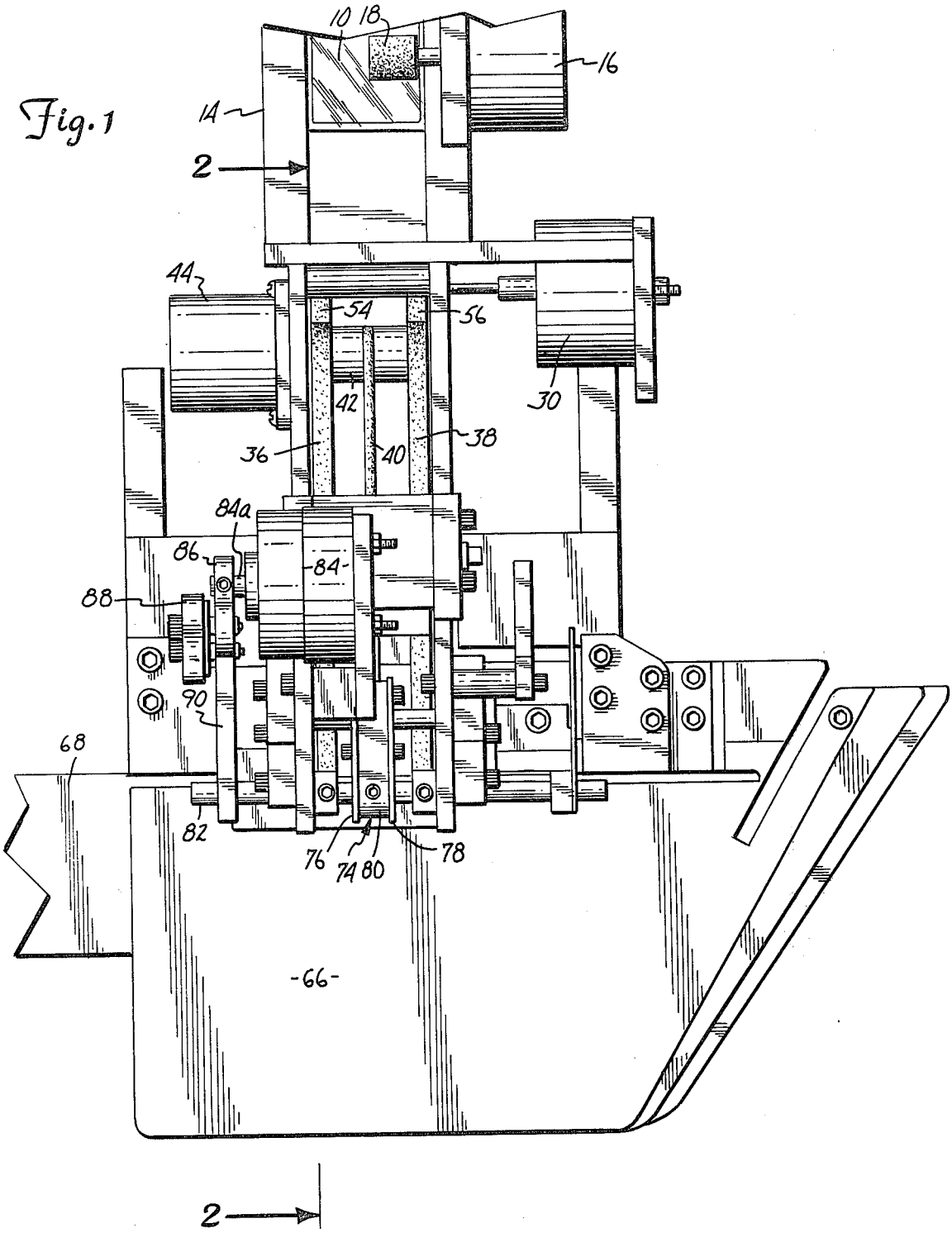
FIG. 1 is a plan view of the film cutting, conveying, and inserting apparatus of the present invention.
Figure 2:
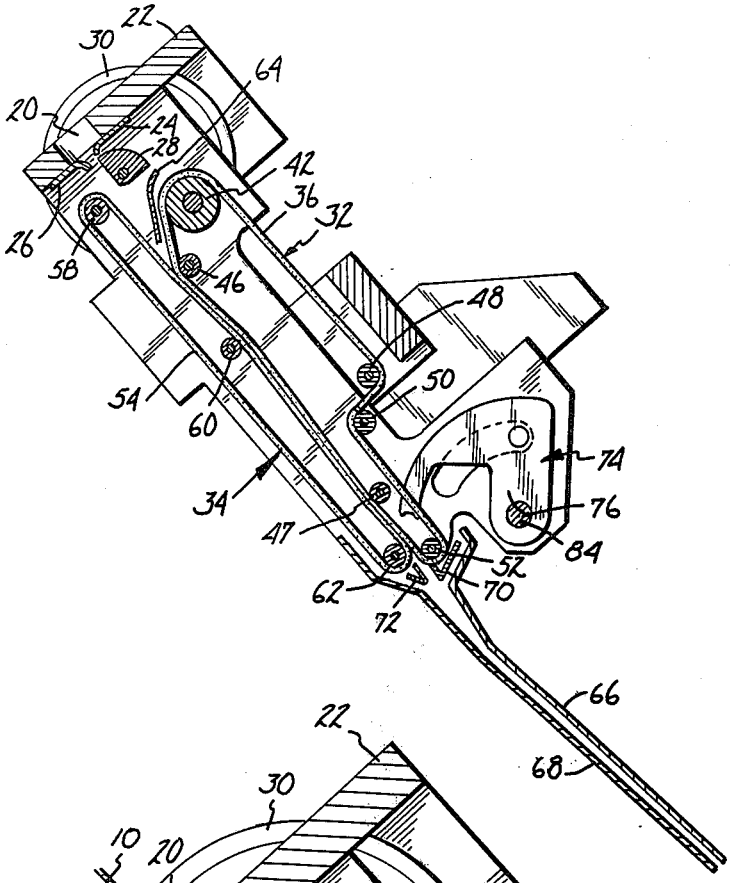
FIG. 2 is a sectional view generally along section 2—2 of FIG. 1.

At the upper end of the apparatus shown in FIGS. 1 and 2, a film guiding track 14 guides film web 10 generally downward. Stepper motor 16 drives roller 18, which advances film web 10 downward.

As film web 10 is advanced downward, it passes through opening 20 in plate 22 and through an opening formed by deflector 24 and fixed knife blade 26. Rotatable knife blade 28, which is driven by rotary solenoid 30, cooperates with fixed blade 26 to sever film segments from film web 10.

A conveyor section of the apparatus includes an upper conveyor belt assembly 32 and a lower conveyor belt assembly 34. Upper conveyor belt assembly 32 includes a pair of conveyor belts 36 and 38, timing belt 40, belt drive stepper motor 44, and idler rollers 46, 47, 48, 50 and 52. Lower conveyor belt assembly 34 includes conveyor belts 54 and 56, and idler rollers 58, 60 and 62.

As shown in FIG. 2, the receiving end of lower belt assembly 34 is more closely positioned to the knife location (defined by fixed blade 26) than is the receiving end of the upper belt assembly 32. Drive roller 42 and idler roller 46 of upper assembly 32 are positioned so that the portion of the belt run between rollers 42 and 46 is inclined with respect to the run of the lower belts between idler rollers 58 and 60. Deflector 64 is positioned to deflect the leading edges of film 10 into the nip defined by upper belts 36 and 38 and lower belts 54 and 56.

Figure 7:
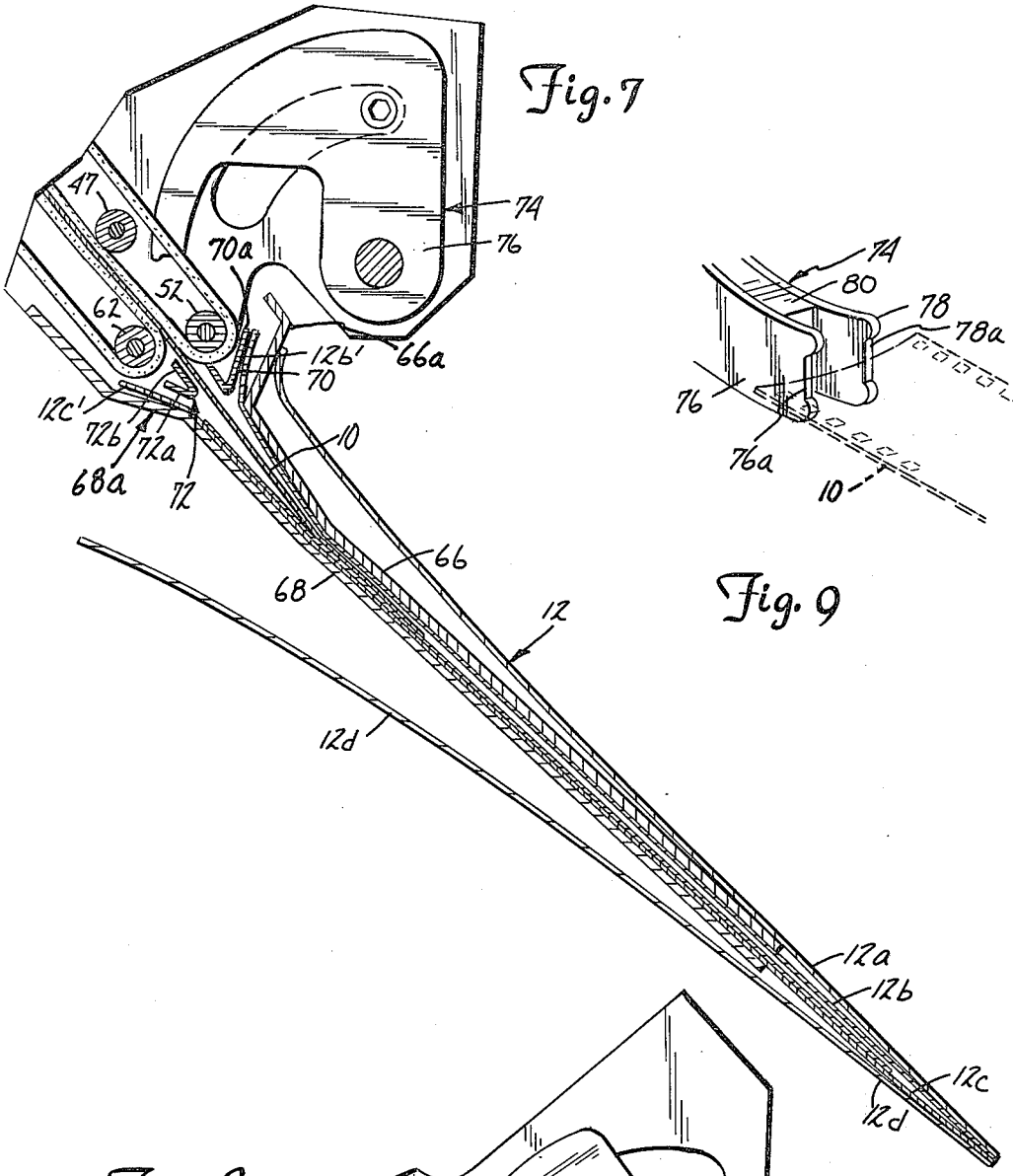
FIGS. 7 and 8 are partial sectional views along section 2—2 showing film segments being inserted between layers of a multi-layer packaging strip.
Figure 8:
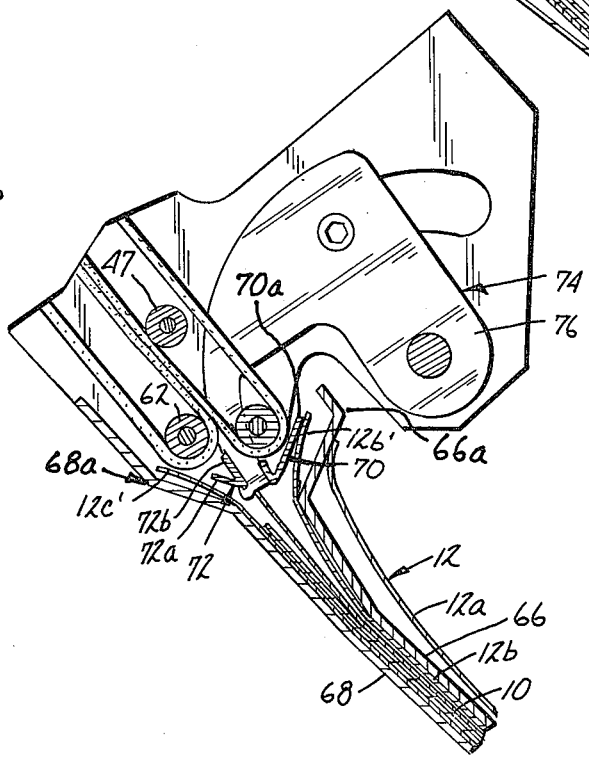

Cut film segments are conveyed by upper and lower conveyor assemblies 32 and 34 generally downward and inserted between separated layers of packaging strip 12. As shown in FIGS. 7 and 8, separators 66 and 68, and members 70 and 72 separate layers 12*b* and 12*c* of packaging strip 12 to define an insertion opening into which the cut film segments from film strip 10 are inserted. For ease of illustration, packaging strip 12 is not shown in FIGS. 1 and 2, but is shown in FIGS. 7 and 8. The operation of separators 66 and 68, and members 70 and 72 is further illustrated in FIGS. 7 and 8.

The film insertion apparatus further includes a rotatable film pusher 74 which has a pair of film engaging arms 76 and 78 which are spaced from one another in generally parallel relationship by spacer 80. As shown in FIG. 2, film pusher 74 is in its normal, retracted position out of the path of the film segments. Pusher 74 is fixedly attached to rotatable shaft 82, which is driven by a rotary solenoid 84 through link arms 86, 88 and 90. Link arm 86 has one end fixedly attached to shaft 84*a* of solenoid 84, and has its opposite end pivotally connected to arm 88. The opposite end of arm 88 is pivotally connected to one end of arm 90, and the other end of arm 90 is fixedly connected to shaft 82. When solenoid 84 is actuated, it causes shaft 82 to rotate, thereby rotating arms 76 and 78 of film pusher 74 to engage the trailing edge of any film segment which is not fully inserted into the envelope defined by layers 12*b* and 12*c* of packaging strip 12.

The operation of the film cutting, conveying and inserting apparatus of the present invention is illustrated in FIGS. 3–9.

Figure 3:
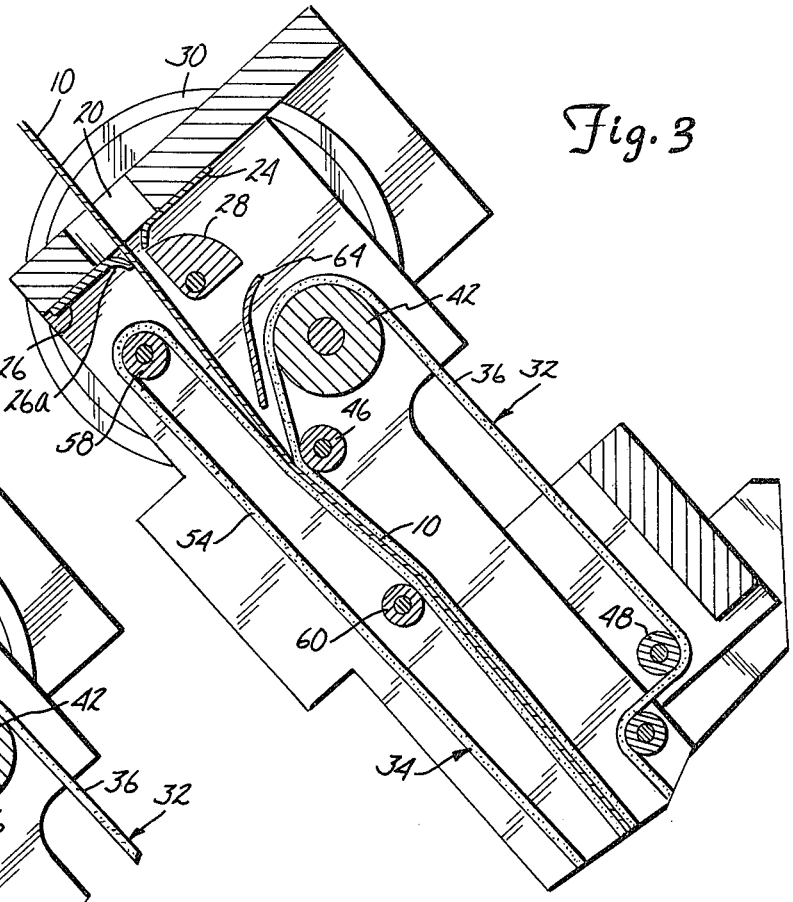
Figure 4:
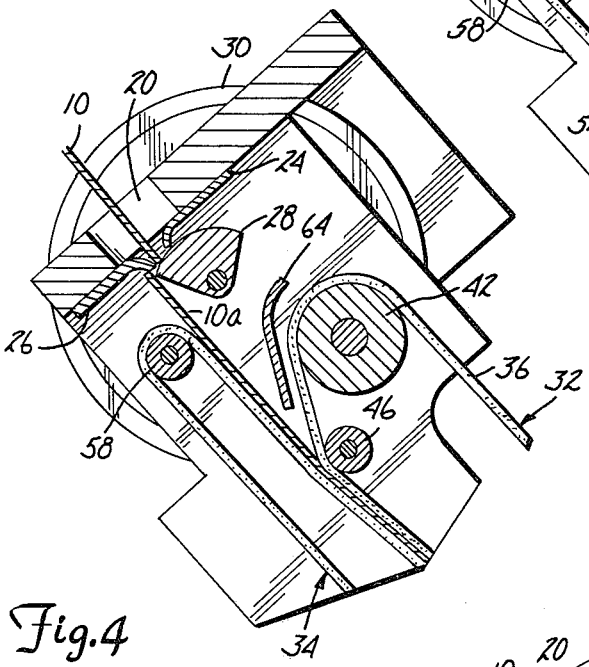

FIG. 3 shows the beginning of the operation of the apparatus for a new customer order. Web 10 is advanced by stepper motor 16 (shown in FIG. 1) through opening 20 and past the knife location defined by fixed knife blade 26. Web 10 continues to be advanced until its leading edge reaches the nip defined by upper belts 36 and 38 and lower belts 54 and 56. At this point, stepper motor 44 is actuated to drive belts 36 and 38 at the same rate that stepper motor 16 is driving film 10. Stepper motors 16 and 44 are driven synchronously until a desired length of web 10 has been advanced past fixed blade 26. At this point, both stepper motor 16 and stepper motor 44 are stopped, and rotary solenoid 30 is actuated. Movable blade 28 rotates into engagement with fixed blade 26 and severs film segment 100 from web 10, as illustrated in FIG. 4.

While movable blade 28 remains in engagement with fixed blade 26, stepper motor 44 is actuated to drive belts 36 and 38 in reverse, thereby causing the trailing edge of segment 100 to be held down by curved portion 26*a* of fixed blade 26. This ensures that the trailing edge of segment 100 is out of the path of the leading edge of web 10.

Figure 5:
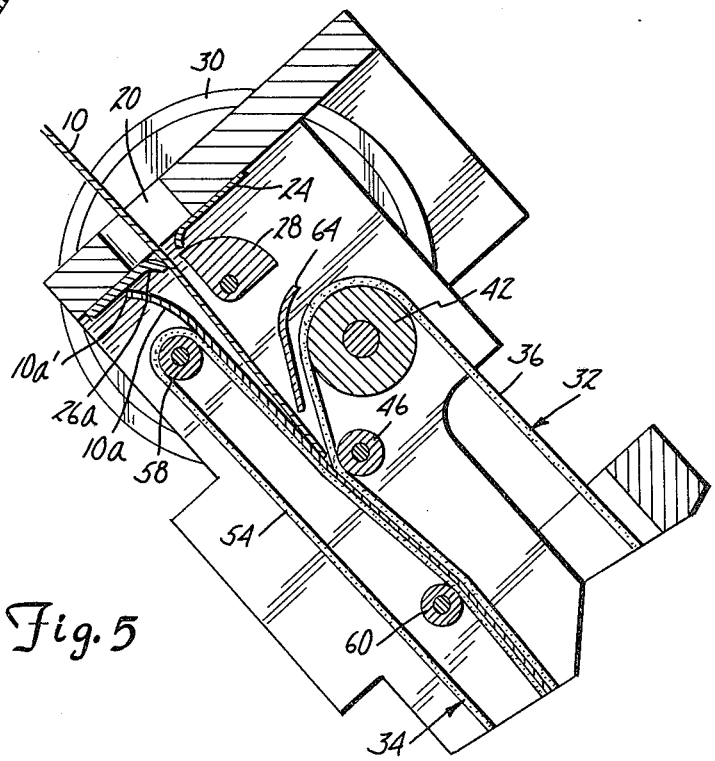

As shown in FIG. 5, web 10 is then advanced by stepper motor 16 until the leading edge of web 10 reaches the nip defined by the upper and lower conveyor belt assemblies 32 and 34. During this advancement of web 10, upper belt assembly 32 is not driven by motor 44, and therefore film segment 100 does not advance downward. This permits a portion of web 10 to overlap segment 100.

Figure 6:
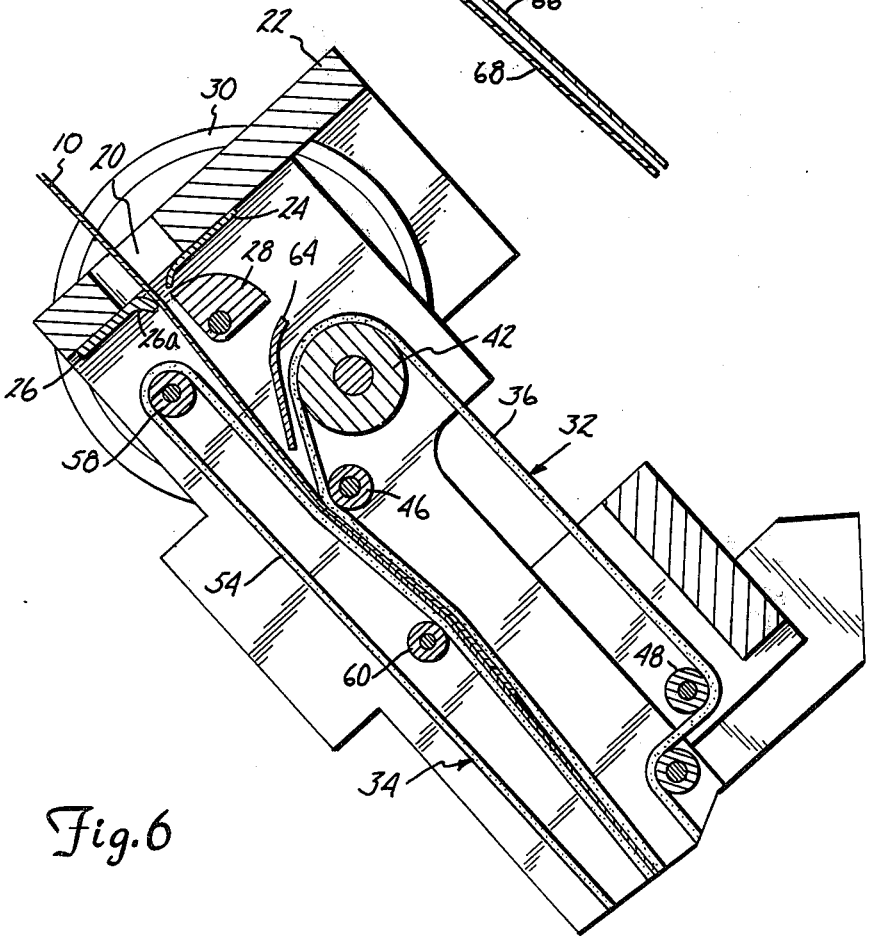
FIGS. 3 through 6 are partial sectional views generally along section 2—2 showing the apparatus of the present invention in operation advancing a film web past a cut location, cutting a first segment from a film web, partially overlapping the first segment with the web, and advancing the web and the first segment together in partially overlapping relationship.

In the next stage of operation, as illustrated in FIG. 6, motor 44 is driven in synchronism with motor 16, so that web 10 and film segment 100 are driven in overlapping relationship through the conveyor portion of the apparatus defined by conveyor belt assemblies 32 and 34. As illustrated in FIG. 6, the distance by which web 10 overlaps cut film segment 100 is determined by the distance by which film segment 100 has been backed up after cutting, and the distance web 10 has been advanced before motor 44 begins to drive upper conveyor belt assembly 32.

The process illustrated in FIGS. 3–6 is repeated as many times as is necessary in order to cut all of the segments of web 10 corresponding to a particular customer's order. In each case, the previously cut segment 100 is backed up and then maintained stationary while web 10 is advanced to overlap the previously cut film segment 100. Once the desired amount of overlap has been achieved, motor 44 is driven in synchronism with motor 16 to drive web 10 and previously cut film segment 100 together in overlapping relationship toward the discharge end of conveyor belt assemblies 32 and 34.

FIG. 7 shows the cut film segments 100 as they are deposited into an insertion opening formed in envelope strip 12. As illustrated in FIG. 7, envelope strip 12 includes four layers, 12*a*, 12*b*, 12*c* and 12*d*. Separators 66 and 68 separate layers 12*b* and 12*c* to form the opening into which the cut film segments 100 are inserted. The upper end 12*b*′ of layer 12*b* is fed between upturned flange 66*a* of separator 66 and portions 70*a* of members 70. The upper end 12*c*′ of layer 12*c* is fed between flange portion 68*a* of separator 68 and portions 72*a* of members 72. It can be seen, therefore, that layers 12*b* and 12*c* are held apart at their upper ends 12*b*′ and 12*c*′ to create an insertion opening into which film segments 100 are driven.

As illustrated in FIG. 7, segments 100 are driven in an overlapping relationship by belt assemblies 32 and 34 generally downward into the insertion opening. As illustrated in FIG. 7, idler rollers 52 and 62 are positioned so that driven belts 36 and 38 slightly overhang lower belts 54 and 56 respectively. Once one segment has been driven out of contact with belts 36 and 38, the partially overlapping segment above it continues to be driven. Member 70 is positioned proximate belts 36 and 38 at the discharge end of the conveyor system. Similarly, member 72 is positioned proximate belts 54 and 56 at the discharge end of the conveyor system. Portions 70*b* of member 70 and portions 72*b* of member 72 contain the trailing edge of the last segment 100 conveyed (if not all segments) in a position to ensure engagement by pusher arms 76 and 78. This allows pusher arms 76 and 78 to sweep through a center opening (not shown) in members 70 and 72 and clear the segments from the film discharge area and drive the segments a final distance into the insertion opening.

Figure 9:
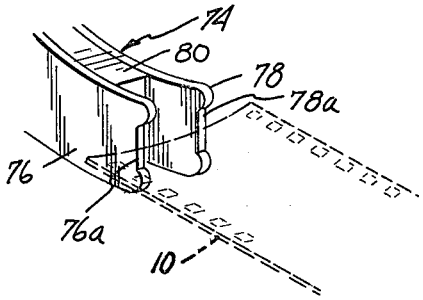
FIG. 9 is a perspective view illustrating operation of a film pushing element.

After the final film segment 100 of a customer's order has been fed between layers 12*b* and 12*c*, solenoid 84 is actuated, which rotates shaft 82 and moves pushing arms 76 and 78 of pusher 74 downward to engage and push the trailing edges of film segments. This operation is shown in FIGS. 8 and 9. By actuating pusher 74, film segments 100 are driven out of any possible contact with conveyor belts 36 and 38 and members 70 and 72. As a result, all film segments 100 are in proper position between layers 12*b* and 12*c*, and will not hang up or tip as packaging strip 12 is advanced along the conveyor bed to further stations where each envelope is sealed on its sides and top and severed from packaging strip 12.

In conclusion, the present invention is a highly advantageous method and apparatus for inserting film segments into an insertion opening in a package. By operating the film strip drive and the conveyor assembly in the manner taught in the present application, the film segments are partially overlapped as they are conveyed and inserted into the insertion opening of the package. This greatly reduces the possibility of film jamming during insertion into the package.

Although the present invention has been described with reference to preferred embodiments, workers skilled in the art will recognize that changes may be made in form and detail without departing from the spirit and scope of the invention.

What is claimed is:

1. A method of inserting photographic film segments into an insertion opening of a package, the method comprising:

severing a first segment from a photographic film web;

advancing the web, while maintaining the first segment stationary, to partially overlap the first segment;

advancing the web and the first segment together in partially overlapping relationship;

severing a second segment from the web; and conveying the first and second segments in partially overlapping relationship into the insertion opening.

2. The method of claim 1 and further comprising:

reversing motion of the first segment after the first segment is severed from the web to cause a trailing edge of the first segment to be positioned out of a path of a leading edge of the web.

3. The method of claim 1 wherein the package comprises a pair of generally parallel members between which the segments are deposited.

4. Apparatus for inserting photographic film segments into an insertion opening of a package, the apparatus comprising:

first conveyor means for advancing a photographic film web past a knife location;

knife means at the knife location for severing film segments from the web;

second conveyor means for conveying the film segments in partially overlapping relationship into the insertion opening; and means for controlling the first and second conveyor means and the knife means to cause the first conveyor means to advance the web a first distance past the knife location while the second conveyor means maintains a previously severed segment stationary so that the web partially overlaps the segment; to then cause the first and second conveyor means to drive, in synchronism, the web and the previously cut segment in partially overlapping relationship toward the insertion opening until a desired cut location is aligned with the knife location; and to then cause the knife means to sever a segment from the web.

5. The apparatus of claim 4 wherein the means for controlling causes the second conveyor means to move the severed segment in a reverse direction after the segment is severed from the web to cause a trailing edge of the segment to be out of a path of a leading edge of the web.

6. The apparatus of claim 5 and further comprising:

deflector means for deflecting the trailing edge of the segment to a position out of the path of the leading edge of the web as the segment is moved in the reverse direction.

7. The apparatus of claim 6 wherein the knife means has a movable blade and a fixed blade, and wherein the deflector means comprises a curved deflection surface of the fixed blade.

8. The apparatus of claim 7 wherein the movable blade has a normal position out of engagement with the fixed blade and a cutting position in engagement with the fixed blade, and wherein the segment is moved in the reverse direction when the movable blade is in the cutting position.

9. The apparatus of claim 4 wherein the second conveyor means has an entrance end positioned to receive the leading edge of the web and a discharge end positioned proximate the insertion opening.

10. The apparatus of claim 9 wherein the package comprises a pair of generally parallel members between which the segments are deposited.

11. A method of inserting photographic film segments into an insertion opening of a package, the method comprising:

advancing a photographic film web past a knife location until a first segment extends beyond the knife location;

stopping the strip;

severing the first segment from the strip;

reversing movement of the first segment to cause a trailing edge of the first segment to be out of a path of a leading edge of the web;

advancing the web past the knife location a predetermined distance to partially overlap the first segment;

advancing the web and the first segment together in partially overlapping relationship until a second segment of the web is advanced past the knife location;

stopping the web and the first segment;

severing the second segment from the web; and advancing the first and second segments together into the insertion opening in partially overlapping relationship.

12. The method of claim 11 and further comprising:

reversing movement of the second segment to cause a trailing edge of the second segment to be out of a path of a leading edge of the web;

advancing the web past the knife location a predetermined distance to partially overlap the second segment;

advancing the web and the second segment together in partially overlapping relationship until a third segment of the web is advanced past the knife location;

stopping the web and the second segment;

severing the second segment from the web; and advancing the second and third segments together into the insertion opening in partially overlapping relationship.

13. A method of inserting photographic film segments into an insertion opening between a pair of generally parallel members, the method comprising:

successively cutting the film segments from a photographic film web;

successively partially overlapping each cut film segment with a following film segment about to be cut between upper and lower generally parallel conveyor belt assemblies through operation of the upper and lower conveyor belt assemblies; and successively conveying the film segments between the upper and lower conveyor belt assemblies in partially overlapping relationship into the insertion opening.

14. Apparatus for inserting photographic film segments into an insertion opening between a pair of generally parallel members, the apparatus comprising:

means for cutting the film segments from a photographic film strip;

upper and lower conveyor belt assemblies positioned in adjoining generally overlapping parallel relation to each other, the conveyor belt assemblies being positioned to receive therebetween a leading portion of the film web, the upper and lower conveyor belt assemblies cooperating to overlap the leading portion of the film web over a previously cut film segment held between the conveyor belt assemblies prior to cutting a subsequent film segment from the leading portion of the film web; and means for driving the conveyor belt assemblies to partially overlap and transport the partially overlapped cut film lengths to a discharge end of the conveyor belt assemblies, whereby the individual cut film lengths are power driven out of the discharge end and into the insertion opening in partially overlapping stacked relation to each other.

* * * * *